US005889227A

United States Patent [19]

Wardecki

[11] Patent Number: 5,889,227

[45] Date of Patent: Mar. 30, 1999

[54] SAFETY MECHANISM FOR PREVENTIVE PREMATURE DETONATION OF AN EXPLOSIVE PROJECTILE

[75] Inventor: Norbert Wardecki, Heuweiler, Germany

[73] Assignee: Buck Werke GmbH & Co., Bad Uberkingen, Germany

[21] Appl. No.: 989,776

[22] Filed: Dec. 12, 1997

[30] Foreign Application Priority Data

Dec. 13, 1996 [DE] Germany ..... 196 51 974.8

[51] Int. Cl.[6] ..... F42C 15/16

[52] U.S. Cl. ..... 102/259; 102/251; 102/256

[58] Field of Search ..... 107/247, 248, 107/249, 251, 254, 255, 256, 259

[56] References Cited

U.S. PATENT DOCUMENTS

| | | | |
|---|---|---|---|
| 3,048,111 | 8/1962 | Baker et al. | 102/259 |
| 3,706,282 | 12/1972 | Lohmann et al. | 102/259 |
| 5,159,150 | 10/1992 | Wardecki | 102/259 |

FOREIGN PATENT DOCUMENTS

| | | | |
|---|---|---|---|
| 602632 | 6/1994 | European Pat. Off. | 102/259 |
| 2678724 | 1/1993 | France | 102/259 |

*Primary Examiner*—Stephen M. Johnson
*Attorney, Agent, or Firm*—Burns, Doane, Swecker & Mathis, L.L.P.

[57] ABSTRACT

An explosive projectile carrying an active charge is to be launched from a barrel. Detonation of the charge requires that a firing pin be driven to a firing position where it impacts a percussion cap. The firing pin is held in a safety position by a barrel probe which is movable to an armed position in a direction perpendicularly to the launch direction. Prior to launching, the barrel probe is held immovable by engagement with both the launch barrel and an acceleration sensor. When the projectile leaves the barrel and acceleration displaces the acceleration sensor, the barrel probe is free to move to its armed position. Also provided are a pretensioned spring, and a pyrotechnical delay element for generating propulsion gas. Either the spring or the delay element functions to move the firing pin to its firing position, and the other of the spring and delay element moves the barrel probe to its armed position.

7 Claims, 4 Drawing Sheets

SAFETY MECHANISM FOR PREVENTIVE PREMATURE DETONATION OF AN EXPLOSIVE PROJECTILE

BACKGROUND OF THE INVENTION

The present invention relates to explosive projectiles and, in particular, to a safety mechanism for preventing premature ignition of a charge carried by the projectile.

Such a projectile is disclosed in U.S. Pat. No. 5,159,150 and comprises a body that is to be fired from a launcher tube (barrel) by means of an expulsion charge. An acceleration sensor moves from a safety position to an armed position upon acceleration of the body as a result of its inertia of mass against the direction of launch. A barrel probe is movable in a direction perpendicular to the launch by a pyrotechnical time delay element from a safety position to an armed position wherein an end thereof extends laterally beyond the body covering. The barrel probe is normally held in its safety position by engagement with the barrel, wherein the barrel probe blocks the movement of a firing pin against a percussion cap that acts upon the active charge. The barrel probe is fixed in the safety position by the acceleration sensor when the latter is in its safety position (i.e., when the body is located in the launcher tube). The firing pin can only contact the percussion cap when the acceleration sensor and the barrel probe are simultaneously in their armed positions. In that event, the firing pin is moved toward the percussion cap by the propulsion gas of a second pyrotechnical delay element. Thus, both the firing pin and the barrel probe are acted upon by respective pyrotechnical delay elements.

Although that device has proven itself, room for improvement remains. For instance, in order to ensure proper operation of the device, it is necessary that the delay times of the two pyrotechnical delay elements be synchronized, or tuned. That requirement has caused difficulties in many applications. In addition, the use of two pyrotechnical delay elements requires that the projectile be constructed in a way that can lead, in particular, to weight and space problems which are especially undesirable, primarily when firing projectiles from an aircraft or similar vehicle.

On the other hand, it is already known how to actuate a barrel probe and a firing pin without the use of a corresponding pyrotechnical delay element, whereby the use of a pyrotechnical delay element is only envisioned to define the ignition time of the active charge. In the process, however, there can arise problems with regard to handling safety, because, when the acceleration sensor, for example, is freed by an impact, an ignition of the active charge cannot be ruled out, even though projectile has not exited the launcher tube.

This invention has as an object the improvement of the afore-described type of safety device, so that with little weight and simple construction the post-firing safety function can be improved, and increased pre-firing safety can be attained to facilitate handling of the projectile in the laboratory and during work with duds.

SUMMARY OF THE INVENTION

This object is accomplished by a projectile adapted to be fired from a launching barrel by an expulsion charge. The projectile comprises a body carrying an active charge, a percussion cap adapted to act upon the active charge, and a firing pin arranged to move from a safety position to a firing position against the percussion cap to detonate the percussion cap. A barrel probe is arranged in a safety position for holding the firing pin in its safety position. The barrel probe is movable to an armed position in a direction perpendicular to a launch direction for releasing the firing pin. An end of the barrel probe is adapted to bear against a launching barrel prior to launching of the projectile, to prevent the barrel probe from moving to its armed position. An acceleration sensor is disposed in a safety position preventing the barrel probe from moving to its armed position. The acceleration sensor is movable to an armed position for releasing the barrel probe in response to acceleration of the body. The firing pin is thereby released only when both the barrel probe and the acceleration sensor are in their armed positions. A pretensioned spring is provided. Also, a pyrotechnical delay element is arranged to be ignited by an expulsion charge upon firing of the projectile in order to generate propulsion gas. Either the spring or the delay element moves the firing pin to its firing position, and the other of the spring and delay element moves the barrel probe to its armed position.

It will be appreciated that the movement of the firing pin to its firing position requires a combination of the expiration of the delay time of the pyrotechnical delay element, and the release of tension on a spring.

In one embodiment the spring pretensions the barrel probe to the armed position, and the delay element is located at least partially in a hollow piston forming the firing pin. The piston exposes the delay element to the hot expulsion gases in order to ignite the delay element. The invention also provides, if necessary, for the rear end of the piston to be essentially closed. The hollow piston is preferably attached to a rear member in a separable manner by an O-ring which is loosened by the effect of the gases from the ignition of the delay element. The rear end of the rear member has a hole exposing the delay element to expulsion gas.

In another embodiment, the spring biases the firing pin toward the percussion cap, and the delay element is so arranged that it moves the barrel probe into its armed position by means of gas pressure.

Finally, the invention also envisions that the active charge be connected in series to a delay element which is connected to the percussion cap and whose delay time determines the decomposition time of the active charge.

The basis of this invention is the surprising discovery that successfully solves the problems of the previously known safety devices by using a combination of a spring and a single pyrotechnical delay element, whereby the spring either acts upon the barrel probe or the firing pin. There results the activation of the active charge only after: (1) the activation of the acceleration sensor (g weight), (2) the release of the barrel probe, and (3) the proper ignition of one delay element by hot gases, for example, by the expulsion charge. Thus, there is no need to tune two delay elements, nor provide extra room for the presence of an additional delay element.

BRIEF DESCRIPTION OF THE DRAWINGS

Two preferred embodiments are described in detail in the following, in conjunction with the appended drawing, in which.

DETAILED DESCRIPTION OF PREFERRED EMBODIMENTS OF THE INVENTION

Figure 1:
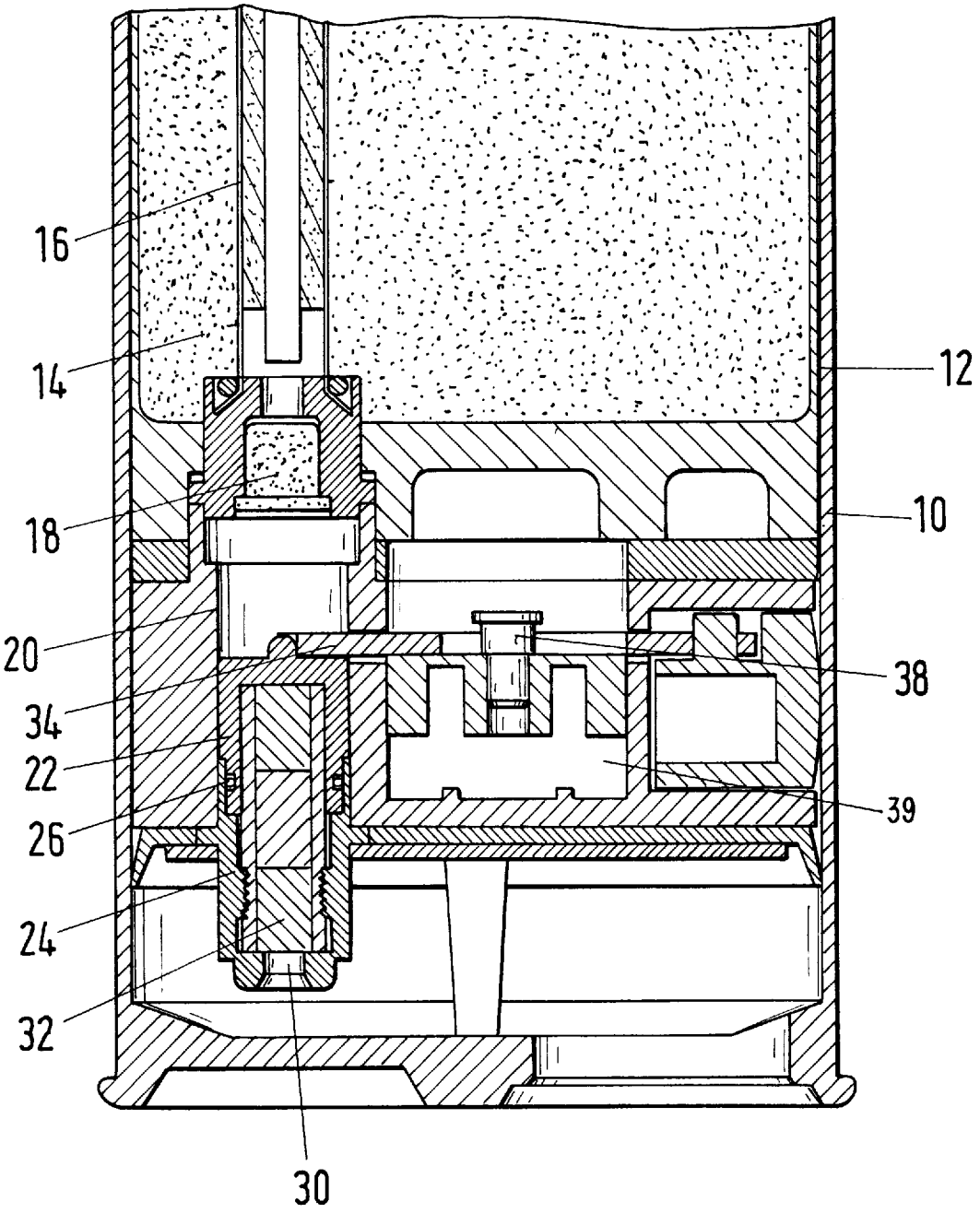
FIG. 1 is a longitudinal sectional view of a first embodiment of a safety device according to the invention.

As can be seen in FIG. 1, inside a launcher tube or barrel 10 there is located a projectile body, comprising a covering 12 inside of which is located an active charge 14 that is ignited by a pyrotechnical ignition charge 16 upon which a percussion cap 18 acts.

The percussion cap 18 is to be impacted by a firing pin in the form of a hollow piston 22 guided in a sliding manner in a cylindrical guide 20 for movement toward the percussion cap 18. Upon its arrival at the percussion cap 18, the piston 22 ignites the ignition charge 16. An O-ring 26 connects the hollow piston 22 to a lower member 24 that is form-fitted to the covering 12 and is thereby relatively fixed in location relative to the covering 12. The rear end or base of the lower member 24 has a bored hole 30 that exposes the interior of the barrel 10 to a pyrotechnical delay element 32, so that the delay element 32 can be acted on and ignited by the hot gases of the expulsion charge upon launching of the projectile.

The hollow piston 22 is held in its safety position shown in FIG. 1 by means of a movable, slide-like, barrel probe 34 mounted perpendicular to the axis of the round and which is pretensioned by a spring 36 toward the interior wall of the barrel 10, i.e., in a right-hand direction in the figure. Thus, movement of the probe 34 to the right is prevented by the barrel 10, and by an acceleration sensor 38 shown in a safety position in FIGS. 1, 2. The barrel probe 34 can only move to the right from its safety position, as shown in FIG. 1, when the round leaves the barrel 10 and an acceleration sensor 38 moves downward (rearward) in response to the appropriate acceleration of the round against the force of a safety spring 40 which is schematically depicted as disposed within a space 39.

Figure 2:
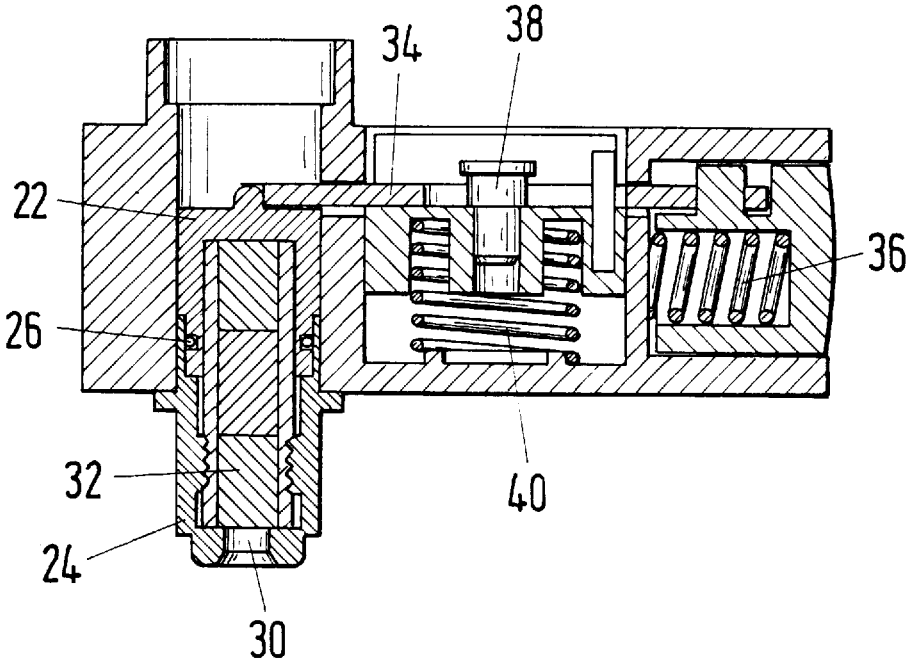
FIG. 2 is a fragmentary view of FIG. 1 depicting the device in greater detail.

The corresponding details of the safety device previously described using the figure are more clearly shown in FIG. 2.

The safety device operates as follows:

In the safety position shown in FIGS. 1 and 2 a three-fold pre-tube safety is guaranteed by the barrel probe 34 and the acceleration sensor 38 being in their respective safety positions, and by the pyrotechnical delay element 32 not being ignited. As soon as the body is launched, the hot expulsion exhaust gases ignite the delay element 32 through the bored hole 30. The increasing acceleration of the round causes the acceleration sensor 38 to move against the force of the safety spring 40 to its armed position, whereby the barrel probe 34 can move to the right in FIGS. 1 and 2 since it no longer rests on the interior wall of the launching barrel 10.

As soon as the barrel probe 34 and the acceleration sensor 38 are brought in this manner to their armed positions, the hollow piston 22 can move toward the percussion cap 18 (FIG. 1). This movement first occurs at the end of the burning of the delay element 32 which determines the delay time. The burning of the delay element 32 produces propulsion gases which cause the O-ring 26 to loosen. Thus, the hollow piston 22 is released and moves with great force against the percussion cap 18. When the hollow piston 22 impacts on the percussion cap 18, it ignites the ignition charge 16, whereby the active charge ignites and explodes.

Figure 3:
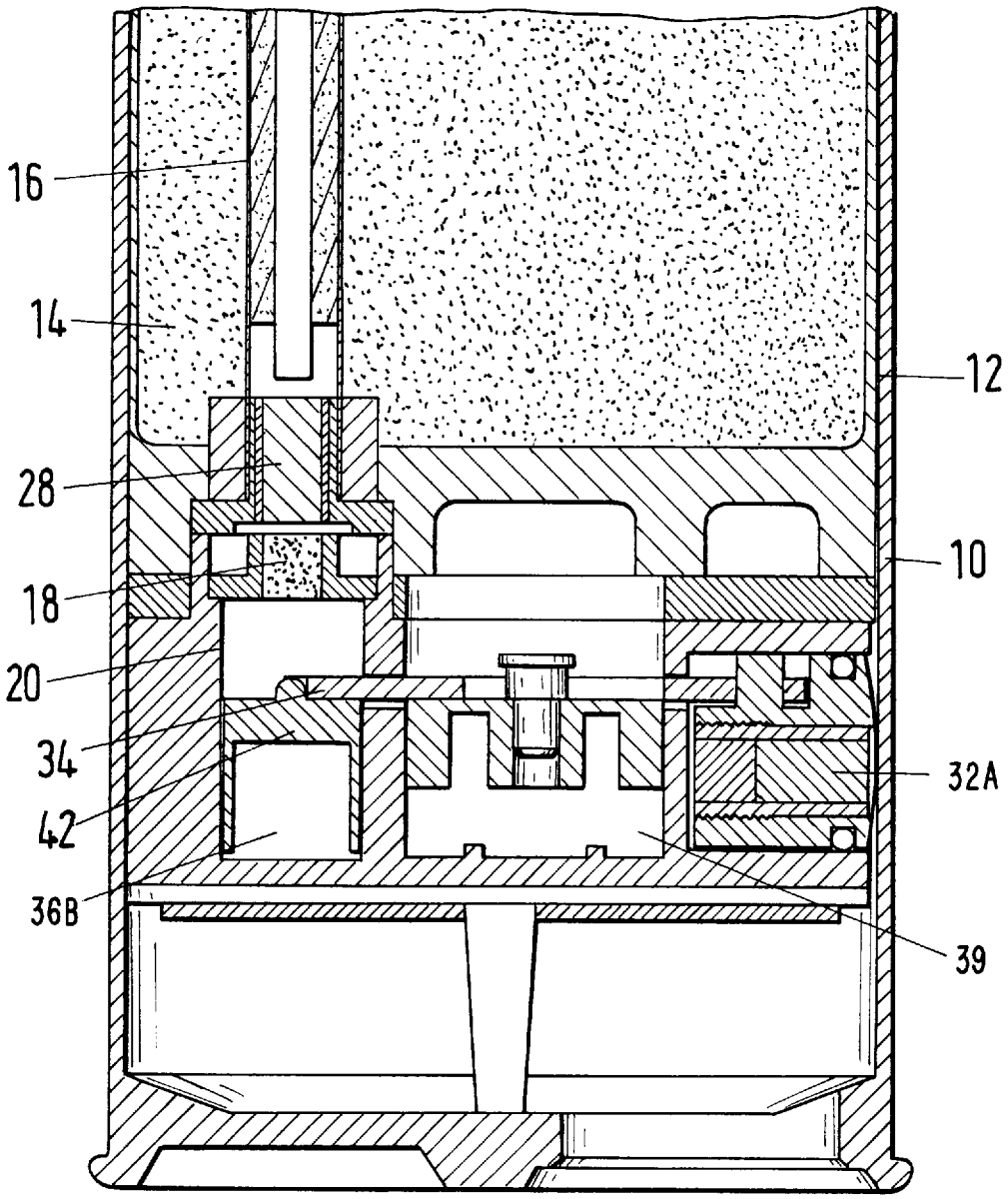
FIG. 3 is a view similar to FIG. 1 of a second embodiment of the invention.
Figure 4:
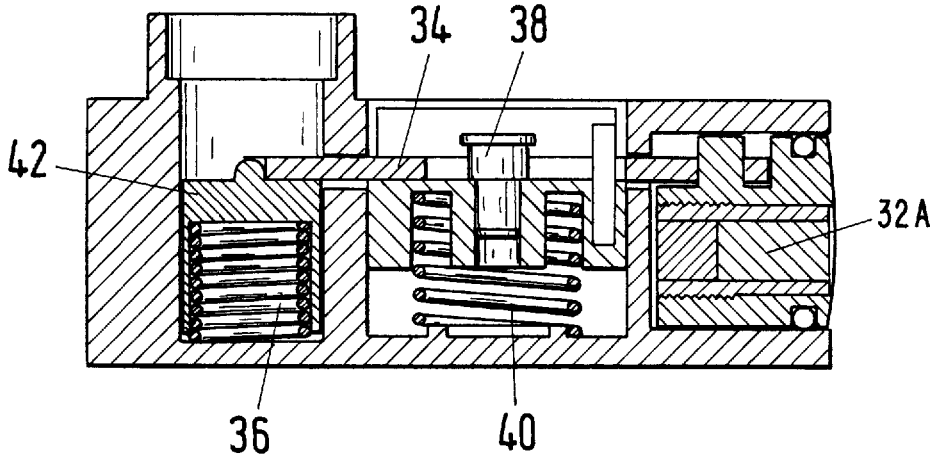
FIG. 4 is a view similar to FIG. 2 of the second embodiment.

Now turning to the preferred embodiment of FIGS. 3 and 4, the parts therein corresponding to those of FIGS. 1 and 2 are given the same reference numerals. The safety device of FIGS. 3 and 4 has a firing pin 42 which is pretensioned in its active position to impact the percussion cap 18 by means of a spring 36A disposed in a space 36B. However, movement of the firing pin 32 is blocked by a barrel probe 34 in its safety position, just as in the embodiment of FIGS. 1 and 2. The barrel probe 34 can only move to the right after the acceleration sensor 18 has moved against the force of the safety spring 40 into its armed position.

In the embodiment of FIGS. 3 and 4, a delay element 32A is provided, but it does not act on the firing pin 42. Instead, it acts on the barrel probe 34. That is, the propulsion gas pressure developed by the burning of the delay element 32A is able to move the barrel probe 34 to the right after the round has left the launcher barrel 10, and thus into its armed position. The safety device of FIGS. 3 and 4 is characterized by a triple safety action when both the barrel probe 34 and the acceleration sensor 38 are in their safety positions, and the delay element 32A has not yet ignited.

During launching, the hot expulsion exhaust gases ignite the delay element 32A. Inside the hollow area housing the delay element 32A a gas pressure begins to build. The acceleration occurring during expulsion of the round moves the acceleration sensor 38 into its armed position. As soon as the round leaves the launcher barrel 10, the propulsion gas pressure arising from the burning of the delay element 32A moves the barrel probe 34 to the right to its armed position, whereby the spring 36A is released and the firing pin 42 moves against the percussion cap 18. Once ignited, the percussion cap 18 ignites a delay element 28, and the ignition charge is thereafter ignited which in turn ignites the active charge. As in the embodiment of FIGS. 1 and 2, the burning of the delay element 32A defines a delay time for the firing.

It will be appreciated that the safety device of the present invention requires only one pyrotechnical delay element for releasing the firing pin. Hence, the problems involved in tuning two such elements are avoided, and the relatively large amount of space required for two pyrotechnical delay elements is not needed.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A projectile adapted to be fired from a launching barrel by an expulsion charge, comprising:

a body carrying an active charge;

a percussion cap adapted to act upon the active charge;

a firing pin arranged to move from a safety position to an armed position against the percussion cap to detonate the percussion cap;

a barrel probe arranged in a safety position for holding the firing pin in its safety position, the barrel probe being movable to an armed position in a direction perpendicular to a launch direction for releasing the firing pin, an end of the barrel probe adapted to bear against a launching barrel prior to launching of the projectile, to prevent the barrel probe from moving to its armed position;

an acceleration sensor disposed in a safety position preventing the barrel probe from moving to its armed position, the acceleration sensor being movable to an armed position for releasing the barrel probe in response to acceleration of the body;

whereby the firing pin is released only when both the barrel probe and the acceleration sensor are in their armed positions;

a pretensioned spring; and a pyrotechnical delay element arranged to be ignited by an expulsion charge upon firing of the projectile for generating propulsion gas;

one of the spring and delay element being operable to move the firing pin to its firing position, and the other of the spring and delay element being operable to move the barrel probe to its armed position.

2. The projectile according to claim 1 wherein the firing pin is movable to its firing position by propulsion gas pressure from the pyrotechnical delay element, and the barrel probe is movable to its armed position by the pretensioned spring.

3. The projectile according to claim 2 wherein the firing pin is hollow, and the pyrotechnical delay element is mounted in the firing pin.

4. The projectile according to claim 3 wherein the firing pin comprises a front piston mounted in a rear member, a rear end of the rear member being open for enabling the pyrotechnical delay element to be ignited by the expulsion charge.

5. The projectile according to claim 4 wherein the piston is releasably attached to the rear member by an O-ring adapted to be loosened by the gas emitted by the pyrotechnical delay element.

6. The projectile according to claim 1 wherein the firing pin is movable to its firing position by the pretensioned spring element, and the barrel probe is movable to its armed position by gas pressure from the pyrotechnical delay element.

7. The projectile according to claim 1 further including a delay element between the percussive cap and the active charge for delaying ignition of the active charge.

* * * * *